United States Patent [19]

Sato et al.

[11] Patent Number: 4,981,559

[45] Date of Patent: Jan. 1, 1991

[54] PROCESS OF ELECTROPLATING BY LIQUID INJECTION

[75] Inventors: Atsuhiko Sato, Kobe; Nobutoshi Takemura, Hirakata, both of Japan

[73] Assignee: Uemura Kogyo Kabushiki Kaisha, Osaka, Japan

[21] Appl. No.: 308,482

[22] Filed: Feb. 10, 1989

[51] Int. Cl.[5] ..... C25D 5/08

[52] U.S. Cl. ..... 204/14.1; 204/23; 204/237; 204/273

[58] Field of Search ..... 204/273, 275, 237, 14.1, 204/23

[56] References Cited

U.S. PATENT DOCUMENTS

| | | | |
|---|---|---|---|
| 3,763,028 | 10/1973 | Ryerson et al. | 204/237 |
| 4,174,261 | 11/1979 | Pellegrino | 204/273 |
| 4,443,304 | 4/1984 | Eidschun | 204/273 X |
| 4,534,843 | 8/1985 | Johnson et al. | 204/237 X |
| 4,773,983 | 9/1988 | Shyu | 204/273 |

*Primary Examiner*—Donald R. Valentine
*Attorney, Agent, or Firm*—Armstrong, Nikaido, Marmelstein, Kubovcik & Murray

[57] ABSTRACT

A plating apparatus of a plating liquid injection type comprises a plating bath, which is filled with plating liquid, for accommodating a plurality of block-like works, plating liquid injection mechanisms disposed at opposite sides of the works for injecting the plating liquid toward the works, the plating liquid injection mechanisms including a plurality of plating liquid injecting portions which are spaced from each other and are adjustable at injection angles thereof, an overflow tank arranged outside the plating bath for collecting the plating liquid overflowed from the plating bath, and a plating liquid returning mechanism including a pump and connecting the overflow tank to the plating liquid injection mechanism, the plating bath being adapted to foam a storage tank for storing the plating liquid when the pump stops.

2 Claims, 1 Drawing Sheet

PROCESS OF ELECTROPLATING BY LIQUID INJECTION

BACKGROUND OF THE INVENTION (1)Field of the Invention

The present invention relates to a plating apparatus for processing a plurality of block-like works such as calipers or brackets of disk brakes or other parts for automobiles as one works, group, and particularly to the plating apparatus of a plating liquid injection type in which plating liquid is injected to the works by a plurality of plating liquid injection nozzles while electroplating is being performed.

(2)Description of the Prior Art

Japanese patent application No. 58-31478 (first laid-open publication No. 59-157300) commonly assigned to, has disclosed an example of a plating apparatus for processing plate-like works. In this apparatus, a plurality of plating liquid injection nozzles are disposed at opposite sides of one plate-like work suspended in a plating bath, so that the plating liquid is injected onto the work during the plating operation.

In this apparatus and other conventional apparatus, the plating liquid is supplied to the injection nozzles by a pump from a storage tank disposed under the plating bath, so that the liquid injected into the plating bath flows down to the storage tank. The Japanese patent application No. 58-40190 (first laid-open publication No. 59-166697) commonly assigned with this application has disclosed an example of a structure including a storage tank independent of a plating bath.

The present inventor has tried to utilize the plating apparatus of the liquid injection type, which has been utilized only for the plating of the plate-like works, for plating a plurality of block-like works, such as calipers or brackets of disk brakes or other parts for automobiles.

However, the following problems have been found when the conventional apparatus is used without improvement for the plating of the block-like works.

In the plating of a plurality of the block-like works, it is desirable to change or adjust the direction of the injected liquid in order to reduce the processing time and to improve the quality. However, in conventional structures, it is impossible to individually adjust the direction of each injection nozzle.

Further, in the plating of automobile parts, it is necessary to use a plating liquid having strong tendency to foam or bubble so as to reduce the processing time and to improve the quality.

However, in the conventional apparatus, when the process stops after each operation, the plating liquid in the plating tank flows down into the storage tank, and the plating tank becomes empty until the next operation starts. It is therefore necessary to fill to the plating tank by supplying plating liquid, by means of the pump through the nozzles prior to the next operation. This injection of the plating liquid, having a strong tendency to foam into the empty plating tank causes, the entire bath to foam, so that the actual plating operation can not be started until the foam dissipates.

SUMMARY OF THE INVENTION

Accordingly, it is an object of the invention to provide an improved apparatus, overcoming the above-noted problems.

According to the invention, a plating apparatus of a plating liquid injection type, comprises a plating bath tank, which is filled with plating liquid, for accommodating a plurality of block-like works, and plating liquid injection mechanisms, disposed at opposite sides of the works for injecting the plating liquid toward the works, the plating liquid injection mechanisms including a plurality of plating liquid injecting portions which are spaced from each other and are adjustable at injection angles thereof.

Further, in the invention, a plating apparatus, of a plating liquid injection type, comprises a plating bath, tank which is filled with plating liquid, for accommodating a plurality of block-like works, plating liquid injection mechanisms disposed in the plating bath for injecting the plating liquid toward the works, an overflow tank arranged outside the plating bath tank for collecting the plating liquid overflowing from the plating bath, and a plating liquid returning mechanism, including a pump, and connecting the overflow tank to the plating liquid injection mechanism, the plating bath tank being adapted to storage the plating liquid when the pump stops.

BRIEF DESCRIPTION OF THE DRAWINGS

Embodiments of the invention will now be described by way of example only, with reference to the accompanying drawings, in which.

DETAILED DESCRIPTION OF THE PREFERRED EMBODIMENTS

Figure 1:
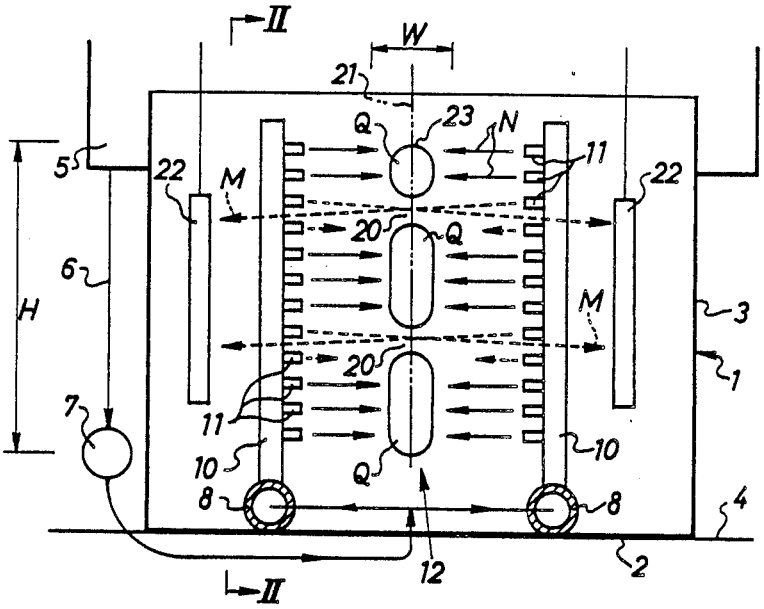
FIG. 1 is a schematic vertical sectional view of an embodiment of the invention.
Figure 2:
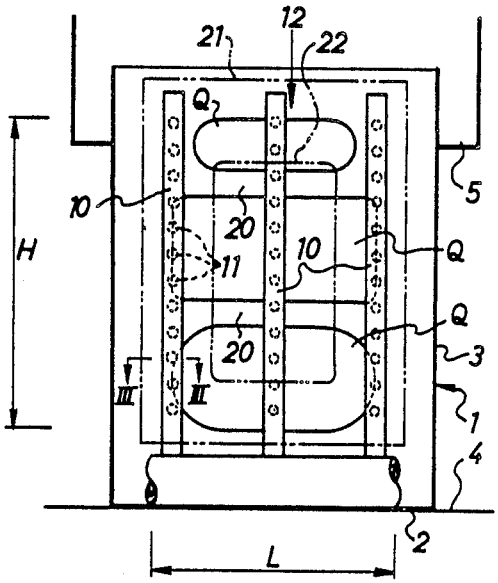
FIG. 2 is a schematic sectional view taken along line II—II in FIG. 1.

Referring to FIGS. 1 and 2, a plating bath 1 includes a bottom wall 2 and side walls 3, and is installed on a base 4. An overflow tank or collection groove 5 for plating liquid is arranged outside the upper portion of the side walls 3. The collection groove 5 is connected at the bottom through a return pipe 6 provided with a pump 7 to a pair of pipes 8 in its plating bath 1.

The pipes 8 horizontally extend on the bottom of the bath 1 and are spaced from each other in the lateral (right to left in FIG. 1) direction. As shown in FIG. 2, riser pipes 10 extend upwardly from longitudinally (right to left in FIG. 2) spaced portions in each pipe 8. All or some of the riser pipes 10 are connected to the pipes 8 by appropriate means such as joint mechanisms (not shown), so that the pipes 10 may be turned to adjust the angular positions around the vertical center lines thereof or around lines parallel to the center lines, respectively.

As shown in FIG. 1, each pipe 10 is provided, at vertically spaced portions, with plating liquid injection nozzles 11 which are directed to an area 12 or space for works Q. Each nozzle 11 is so constructed that the injection angle thereof can be adjust in the all directions. Specifically, the nozzles 11 have structures, e.g., as shown in FIG. 3.

Figure 3:
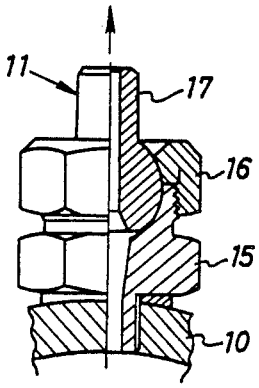
FIG. 3 is an enlarged sectional view taken along line III—III in FIG. 2.

Referring to FIG. 3, the nozzle 11 includes a cylindrical bolt-like member 15, a nut-like member 16 and a nozzle member 17. The member 15 has an external thread at its base end, which is fixedly fitted into a thread aperture in a wall of the pipe 10. The nut-like member 16 is fitted to a thread on the other end of the bolt-like member 15. The nozzle member 17 has a spherical surface at the base end, which is pivotably fixed to a concave spherical seat surfaces formed at the leading end of the bolt-like member 15 and the inner periphery of the nut-like member 16.

Referring to FIG. 1, said area 12 or space for the works Q has a vertical height H, a lateral width W and longitudinal length L (FIG. 2), and a is formed between laterally spaced two groups of the pipes 10. In this area 12, a plurality of works Q, e.g., parts of disk brakes for automobiles in the illustrated embodiment, are located with vertical and/or horizontal spaces 20 therebetween. The works Q are held by a holder or jig 21, e.g., of square frame-like shape.

Some of the nozzles 11 have injection directions set toward the spaces 20 between the works Q, as indicated by dotted arrows M in FIG. 1. Other nozzles 11 have injection directions set toward the works Q, as indicated by solid arrows N. Further, the nozzles 11 directed toward the spaces 20 and disposed at opposite sides of the area 12 are angularly shifted from each other so that the injected liquid from the opposite nozzles 11 may not collide against each other.

Anodes 22 are located between the work area 12 and the side walls 3. The anodes 22 face the area 12, so that the central portions of the anodes 22 may be aligned with the central portion of the area 12 substantially in a lateral direction. The anodes 22, at the opposite sides, have dimensions smaller than the height H and the length L of the area 12, and have effective surface area which is substantially smaller than (e.g., a half of) the surface area of the work Q.

During the plating operation, the pump operates to supply the plating liquid through the pipes 8 and 10 to the nozzles 11. A part of the liquid injected from the nozzles 11 flows in the direction indicated by the arrows N to collide against the works Q, and stirs the plating liquid around the works Q. The other part of the injected liquid passes through the spaces 20 and around the works Q, and further flows through spaces between the pipes 10 to the anodes 22 to stir the liquid around the anodes 22. Thus, the entire liquid in the plating bath 1 is sufficiently stirred, so that a plating liquid having high metal concentration is always supplied to the surfaces of the works Q. Therefore, plating layers having high accuracy can be formed on the works Q in a short time.

When the sizes of the works Q to be treated changes, and/or the positions, and/or numbers of the works Q mounted in the jig 21 change in accordance with the change of the specifications of the works Q, the injection directions of the nozzles 11 are changed to maintain the injection conditions as disclosed above. By removing and re-attaching the nut-like members 16, the nozzle members 17 can be changed for different nozzles having ports of different size. Further, the angular positions of the riser pipes 10 may be changed so as to adjust the injection directions of the nozzles 11, and thus to maintain said injection condition.

In the operation disclosed above, if the anodes were arranged in regions or spaces wider than the area 12, the electric current density at the edges (e.g., edges 23 in FIG. 1) of the work Q would become higher than that at other portions, so that the plating at the edges would undesirably thick. In contrast with this, since the small anodes 22 are used in the illustrated embodiment, as described above, it is possible to prevent the concentration of the current at the edges, and thus the thickness of the plating can be uniform throughout the work Q.

As the nozzles 11 continue to inject the plating liquid, the liquid accumulates and flows over the upper ends of the plating bath tank 1 into the collection groove 5. This liquid flows from the groove 5 into the pipe 6, and then is re-injected into the plating bath 1 by means of the pump 7.

In the operation described above, the plating liquid flowing into the collection groove 5 is the liquid stirred by the jets indicated by the arrows M and thus has the high metal concentration. This liquid is re-injected from the nozzles 11 after flowing only through a short passages, such as the pipe 6 and others, without hold up in a conventional large storage tank. Therefore, the liquid injected from the nozzles 11 has the high metal concentration, which also contributes to the formation of the precious plating layer in a short time.

When the pump 7 stops after the operation, the injection from the nozzles 11 also stops. However, the plating liquid does not flows out from the plating bath tank 1, but remains there. Therefore, when the pump 7 starts in the beginning of the next plating operation, the liquid is not injected from the nozzles 11 into the air but into remaining liquid. Therefore, although the liquid has the strong tendency to foam, the foam is not substantially produced in the plating bath 1 even at the beginning of the operation.

Although not illustrated, a plating system usually includes a plurality of plating bath tanks 1 and other treatment baths or tanks, which may be aligned in the horizontal direction, and the works Q mounted in the jigs 21 are suitably transported by a transporter, e.g., of an elevator type and/or hoist type and are dipped therein in sequence.

According to the invention, as described hereinbefore, the directions of the injection nozzles 11 and/or the angular positions of the pipes 10 can be individually adjusted in accordance with the sizes and/or positions of the works, the plating liquid can always be injected at optimum conditions. Therefore, the present invention can provide optimum condition for plating a plurality of the block-like works, in which the operation time can be reduced and the treatment accuracy can be improved.

Further, in the present invention, in contrast with the conventional apparatus of the liquid injection type, since the plating liquid can be held in the plating bath tank 1 during stoppage of the process, it is possible to prevent the formation of foam conventionally formed as the liquid is ejected from the nozzles 11 into the plating bath at the start of the operation.

In modifications of the invention, all of the nozzles 11 may be directed toward the works Q, as indicated by the arrows N.

One or some pipes 10 may be rigidly fixed to the pipe 8 without permitting the adjustment thereof. All of the nozzles 11 can be rigidly fixed to the pipes 10, in which case the riser pipes 10 must be adjustably connected to the pipes 8. If all of the nozzles 11 are adjustably fixed to the pipes 10, all of the pipes 10 may be rigidly fixed to the pipes 8.

What is claimed is:

1. A process of electro plating a multiplicity of workpieces in a plating liquid injection type of apparatus, including a plating bath tank, means therein to hold a plurality of cathodic workpieces and multiple adjustable nozzle means for impinging plating bath against said workpieces, which comprises: disposing a multiplicity of said workpieces in said tank; adjusting the direction of said nozzles to adapt them to impinge plating bath against said workpieces; substantially filling said tank with said plating liquid to a level at least sufficient to substantially cover said workpieces; spraying said plating liquid from said bath against each of said workpieces by means of a multiplicity of said nozzles; imposing plating current between anode means smaller than said workpiece and said cathodic workpieces, during said spraying, for a time sufficient to plate said workpieces; removing said plated workpieces from said tank without removing all of the plating liquid therefrom; disposing different workpieces in said tank; adjusting the nozzle directions and plating bath depth to accommodate said different workpieces; and then repeating the spraying and plating current steps as aforesaid whereby plating such.

2. A process as claimed in claim 1, including allowing plating liquid bath to overflow from said tank during said plating, and recycling said overflow.

* * * * *